US005718793A

United States Patent [19]

Inamoto et al.

[11] Patent Number: 5,718,793

[45] Date of Patent: Feb. 17, 1998

[54] IMAGE FORMING PROCESS AND PRINTED ARTICLE

[75] Inventors: Tadayoshi Inamoto, Hachioji; Tokuya Ohta; Shoji Koike, both of Yokohama, all of Japan

[73] Assignee: Canon Kabushiki Kaisha, Tokyo, Japan

[21] Appl. No.: 606,846

[22] Filed: Feb. 26, 1996

[30] Foreign Application Priority Data

Feb. 28, 1995 [JP] Japan ..... 7-040267
Oct. 23, 1995 [JP] Japan ..... 7-274127

[51] Int. Cl.[6] ..... B41M 5/00; B41J 2/01

[52] U.S. Cl. ..... 156/235; 347/105; 428/195; 428/209; 428/210; 428/211; 428/423.1; 428/913; 428/914; 503/201; 503/227

[58] Field of Search ..... 8/471; 428/195, 428/913, 914, 209–211, 423.1; 503/227, 201; 156/235; 347/105

[56] References Cited

U.S. PATENT DOCUMENTS 5,006,502 4/1991 Fujimura et al. ..... 503/227
5,515,093 5/1996 Haruta et al. ..... 347/101

FOREIGN PATENT DOCUMENTS 47-51734 12/1972 Japan ..... 503/227
52-5843 1/1977 Japan ..... 8/471
60-8959 5/1978 Japan ..... 503/227
54-59936 5/1979 Japan ..... 347/101
5-309956 11/1993 Japan ..... 503/227
6-143792 5/1994 Japan ..... 503/227

OTHER PUBLICATIONS

Nikkei Electronics No. 305, "Down sized apparatus for a color hard copy, which appear all together for aiming an enlargement of market", Dec. 6, 1982, pp. 125–148 (only p. 125 translated).

IEEE Transactions On Industry Applications, vol. IA–13, No. 1, "Ink Jet Technology", Jan./Feb. 1977, pp. 95–105.

*Primary Examiner*—Bruce H. Hess

*Attorney, Agent, or Firm*—Fitzpatrick, Cella, Harper & Scinto

[57] ABSTRACT

Disclosed herein is an image forming process, comprising the steps of:

ejecting droplets of a liquid ink containing a disperse dye according to predetermined information to form an image on an ink-absorbent printing sheet;

bringing the printing sheet into close contact under heat with an ink-nonabsorbent base material having a receiving layer for receiving the disperse dye to diffuse the disperse dye into the receiving layer; and separating the printing sheet from the base material, wherein the receiving layer comprises a resin having a pencil hardness of H or harder as determined by the pencil hardness test in accordance with JIS K 5400.

46 Claims, No Drawings

IMAGE FORMING PROCESS AND PRINTED ARTICLE

BACKGROUND OF THE INVENTION

1. Field of the Invention

The present invention relates to a process for forming images on base materials such as pottery, glass, ceramics and metals, which have high heat resistance but have no ink absorbency, and printed articles obtained thereby.

2. Related Background Art

As processes for forming images on base materials such as pottery, glass, ceramics and metals, which have high heat resistance but are not absorbent of liquid ink components, there have heretofore been a directly printing process in which printing is performed directly on these base materials, and a process of bonding a synthetic resin film, on which an image has been formed in advance, to these base materials.

The former process is generally performed by gravure printing or offset printing as a printing method. However, these printing processes are expensive and required to fabricate a plate according to the desired pattern. Therefore, this process may not be said to be suitable for small-quantity printing. A process in which an image is directly formed on a base material by an ink-jet recording system without fabricating a plate is also performed in part. Under the circumstances, this process is however applied only to printing of simple characters such as lot numbers on products, and the color is also limited to a single color. In addition, the scratch resistance and wear resistance of the formed image are insufficient because printing is conducted directly on the base material.

On the other hand, the latter process of bonding the image-formed film offers a problem of adhesion between the image-formed film and a base material. Troubles such as peeling are often caused.

As a process for solving these problems, Japanese Patent Publication No. 47-51734 discloses a process in which a synthetic resin film is formed on a base material in advance, and a transfer sheet, on which an image containing a sublimate dye has been formed, is laid on the synthetic resin film under heat to transfer only the disperse dye to the resin film, thereby forming an image. Besides, as a process for forming an image on a transfer sheet, it is disclosed in Japanese Patent Publication No. 60-8959 to use an ink-jet recording system.

However, these disclosures do not contain any specific description as to what resin the material high in strength such as scratch resistance is.

Specific examples of a receiving layer for receiving disperse dyes are disclosed in Japanese Patent Application Laid-Open Nos. 52-5843, 5-309956 and 6-143792. According to Japanese Patent Application Laid-Open No. 52-5843, however, fiber is intended for a base material, and so the principal object in view is to keep the hand feeling of a finished textile good. Therefore, any receiving layer having high mechanical strength such as high scratch resistance cannot be obtained. Japanese Patent Application Laid-Open Nos. 5-309956 and 6-143792 disclose polyester resin compositions having resistance to various stains which form the cause of irregularity of the images formed. These resins are believed to be excellent as a receiving layer for sublimate-transfer image-receiving paper. The transfer image-receiving paper is used in recording systems such as a sublimate transfer system and a melt transfer system and attaches importance to recording speed. Therefore, sublimate dyes low in sublimation temperature are used. When an image of a disperse dye formed on a transfer sheet is transferred to a heat-resistant base material such as pottery, glass, ceramic or metal, however, it is desirable that the transfer be performed at a temperature as high as possible in order to transfer a bright and high-color density image conforming to the image on the transfer sheet to a receiving layer because the disperse dye is effectively dispersed. When the transfer is performed under such conditions, the receiving layer is softened, so that a situation that a mark of the transfer sheet is left in the form of irregularities, or the transfer sheet is not separated in the worst case may be brought on.

SUMMARY OF THE INVENTION

The present invention has been completed in view of the foregoing problems involved in the prior art, and an object thereof is therefore to provide a process which can solve the problems as described above and permits the formation of bright and high-color density images having good weather resistance, scratch resistance and resistance to marker, generating neither mildew nor mold and faithfully conforming to an original image on base materials such as ceramics, for example, earthenware, porcelain and stoneware, glass, plastics, wood, and metals, which have no ink absorbency, and an image formed article (printed article) obtained by such a process.

The above object can be achieve by the present invention described below.

According to the present invention, there is thus provided an image forming process, comprising the steps of:

ejecting droplets of a liquid ink containing a disperse dye according to predetermined information to form an image on an ink-absorbent printing sheet;

bringing the printing sheet into close contact under heat with an ink-nonabsorbent base material having a receiving layer for receiving the disperse dye to diffuse the disperse dye into the receiving layer; and separating the printing sheet from the base material, wherein the receiving layer comprises a resin having a pencil hardness of H or harder as determined by the pencil hardness test in accordance with JIS K 5400.

According to the present invention, there is also provided an image forming process, comprising the steps of:

ejecting droplets of a liquid ink containing a disperse dye according to predetermined information to form an image on an ink-absorbent printing sheet;

bringing the printing sheet into close contact under heat with an ink-nonabsorbent base material having a receiving layer for receiving the disperse dye to diffuse the disperse dye into the receiving layer; and separating the printing sheet from the base material, wherein the receiving layer comprises a resin the pencil hardness of which turns H or harder as determined by the pencil hardness test in accordance with JIS K 5400 by the step of the close contact under heat.

According to the present invention, there is further provided an image forming material, comprising a base material selected from the group consisting of pottery, glass, ceramics and metals; and a receiving layer provided on the base material comprising a resin having a pencil hardness of H or harder as determined by the pencil hardness test in accordance with JIS K 5400.

According to the present invention, there is still further provided a printed article, comprising a base material selected from the group consisting of pottery, glass, ceramics and metals, on which a receiving layer comprising a resin having a pencil hardness of H or harder as determined by the pencil hardness test in accordance with JIS K 5400 is provided; and an image formed with a disperse dye on the receiving layer.

According to the present invention, there is yet still further provided a process for forming an image with an ink on a printing medium, comprising the steps of:

ejecting droplets of an ink containing a disperse dye according to predetermined information to form an image on an ink-absorbent printing medium;

bringing the printing medium into close contact under heat with an ink-nonabsorbent base material having a receiving layer for receiving the disperse dye, the pencil hardness of which is H or harder, to transfer and diffuse the disperse dye to and into the receiving layer;

separating the printing medium from the base material, overcoating at least a part of the receiving layer of the image formed article obtained by the preceding steps with a substantially transparent resin; and then curing the transparent resin.

According to the present invention, there is yet still further provided a process for forming an image with an ink on a printing medium, comprising the steps of:

ejecting droplets of an ink containing a disperse dye according to predetermined information to form an image on an ink-absorbent printing medium;

bringing the printing medium into close contact under heat with an ink-nonabsorbent base material having a receiving layer for receiving the disperse dye, the pencil hardness of which is H or harder, to transfer and diffuse the disperse dye to and into the receiving layer;

separating the printing medium from the base material, subjecting the receiving layer of the image formed article obtained by the preceding steps to a surface treatment;

overcoating at least a part of the receiving layer thus surface-treated with a substantially transparent resin; and then curing the transparent resin.

DESCRIPTION OF THE PREFERRED EMBODIMENTS

The use of a resin having a pencil hardness of H or harder according to the present invention as a receiving layer permits the formation of images having excellent scratch resistance and image durability on base materials such as pottery, glass, ceramics and metals, which have no ink absorbency. In addition, transfer is feasible at a high temperature without causing problems that a mark due to the close contact of a transfer sheet under heat is left upon the transfer of an image, and that a failure to separate the transfer sheet is caused, so that a beautiful printed article can be obtained. Bright and high-color density images are also obtained.

The present invention will hereinafter be described specifically by the preferred embodiments.

Disperse dyes used in the present invention are materials known per se in the art and include water-insoluble azo, anthraquinone and other dyes used widely in dyeing of fibers. These disperse dyes have no hydrophilic groups such as sulfonic and carboxylic groups, each have a molecular weight within a certain range and color synthetic fibers such as polyester and acetate at a temperature of from 80° to 250° C. after applying them in the form of aqueous dispersions to the fibers or fabrics obtained therefrom or during their application.

In the present invention, all the conventionally known disperse dyes may be used. However, preferable disperse dyes in the present invention include C.I. Disperse Yellow 5, 42, 56, 64, 76, 79, 83, 100, 124, 140, 160, 162, 163, 164, 165, 186, 192 and 224; C.I. Disperse Orange 13, 29, 30, 31, 33, 43, 49, 50, 55, 61, 73, 78 and 119; C.I. Disperse Red 43, 54, 56, 72, 73, 76, 88, 91, 92, 93, 103, 111, 113, 126, 127, 128, 135, 143, 145, 152, 153, 154, 164, 181, 188, 189, 192, 203, 205, 206, 207, 221, 224, 225, 227, 257, 258, 288 and 296; C.I. Disperse Violet 27, 35, 38, 46, 52 and 56; C.I. Disperse Brown 1 and 9; C.I. Disperse Blue 54, 60, 73, 87, 94, 113, 128, 139, 142, 143, 146, 148, 149, 158, 167, 176, 183, 186, 187, 197, 198, 201, 205, 207, 211, 214, 224, 225, 257, 259, 267, 268, 270 and 301; and the like.

Among the conventionally-known dispersed dyes, disperse dyes most preferably used in the image forming process according to the present invention are those which have a comparatively high molecular weight and effectively sublimate and transfer at about 180° C. or higher.

The reason for this is that the transfer at a high temperature permits the formation of a bright and high-color density image. When multicolor printing of at least two colors is performed, it is also preferred that all disperse dyes to be used be selected in such a manner that their transfer temperatures are within the above range with a view toward making coloring upon the transfer even.

The measurement of the temperature at which a disperse dye effectively sublimates and transfers may be carried out by an analytical means such as TG, DTA or DSC, or the method prescribed in JIS L 0879. The selection of the preferred dispersed dyes can be easily made by those skilled in the art.

As a medium dispersing or dissolving the disperse dyes as described above therein, any of media used routinely in general dyeing and media used routinely as media for ink-jet recording inks may be used in the present invention. For example, water and/or water-soluble organic solvents are preferred. Examples of the water-soluble organic solvents include alkyl alcohols having 1 to 4 carbon atoms, such as methyl alcohol, ethyl alcohol, isopropyl alcohol, n-propyl alcohol, n-butyl alcohol, sec-butyl alcohol, tert-butyl alcohol and isobutyl alcohol; amides such as dimethylformamide and dimethylacetamide; ketones and keto-alcohols such as acetone and diacetone alcohol; ethers such as tetrahydrofuran and dioxane; polyalkylene glycols such as polyethylene glycol and polypropylene glycol; alkylene glycols the alkylene moiety of which has 2 to 6 carbon atoms, such as ethylene glycol, propylene glycol, butylene glycol, triethylene glycol, hexylene glycol and diethylene glycol; thiodiglycol; 1,2,6-hexanetriol; glycerol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; N-methyl-2-pyrrolidone; 1,3-dimethyl-2-imidazolidinone; and the like.

The media as described above may be used either singly or in any combination thereof. However, the most preferred composition of the medium is a mixed solvent comprising water and at least one organic solvent which comprises at least one water-soluble, high-boiling solvent, for example, a polyhydric alcohol such as ethylene glycol, propylene glycol or glycerol. These media may be used in such an amount that the content of the disperse dye amounts to about 0.1 to 15% by weight upon the preparation of an ink composition.

Although the ink composition used in the present invention is as described above, conventionally-known various dispersants, surfactants and viscosity modifiers may be further added as needed.

As the dispersants or surfactants which may be added as needed, anionic dispersants or surfactants such as fatty acid salts, salts of alkylsulfates, alkylbenzenesulfonates, alkylnaphthalenesulfonates, dialkylsulfosuccinates, alkylphosphates, naphthalenesulfonic acid-formalin condensates and polyoxyethylene alkylsulfates; and nonionic dispersants or surfactants such as polyoxyethylene alkylphenyl ethers, polyoxyethylene fatty acid esters, sorbitan fatty acid esters, polyoxyethylene sorbitan fatty acid esters, polyoxyethylene alkylamines, glycerol fatty acid esters and oxyethylene-oxypropylene block copolymers are important.

As the viscosity modifiers, water-soluble natural or synthetic polymers such as carboxymethylcellulose, sodium polyacrylate, polyvinyl pyrrolidone, gum arabic and starch are principally preferred. The ink compositions used in the present invention are adjusted to a viscosity of 50 cP or lower, preferably 1 to 10 cP with or without these viscosity modifiers.

When an ink composition to be used in an ink-jet recording system of a type that ink is electrified is prepared, an inorganic salt such as lithium chloride, ammonium chloride or sodium chloride is added as a resistivity regulative agent.

When an ink composition is applied to an ink-jet recording system of a type that ink is ejected by the action of thermal energy, its thermal properties (for example, specific heat, coefficient of thermal expansion, thermal conductivity, etc.) may be adjusted.

In addition to the above three additives, for example, an antifoaming agent, penetrant, mildew-proofing agent, pH adjustor, etc. may be suitably added as needed.

Ink-jet printing ink compositions used in the present invention can be generally prepared by mixing the above-described components, grinding the mixture by the conventionally-known means, for example, a ball mill, a sand mill, a speed line mill, optionally controlling the concentration of the mixture with a medium and finally adjusting its pH to 4 to 10. The particle diameter of the disperse dye is generally controlled to about 30 μm or smaller, reparably about 20 μm or smaller. If the particle diameter is too great, problems such as clogging at an orifice are caused upon ink-jet printing. When a medium dissolving the disperse dye therein is selected as the medium, an ink composition usable in the present invention can be obtained by simple dissolving operation such as heating.

An ink-jet recording method is used as an image-forming process in the present invention. The use of the ink-jet recording method make an expensive printing press useless, and so a plate is also unnecessary. This brings about the following advantages. An image formed article can be provided more cheaply, and delivery time of products can also be shortened to an extremely great extent.

As the ink-jet recording method usable in the present invention, any system may be used so far as it is a system that droplets of the ink composition can be ejected according to predetermined information to form an image on a printing sheet. Typical examples of such systems are described in, for example, IEEE Transactions on Industry Applications, Vol. IA-13, No. 1 (the January/February 1977 issue) and Nikkei Electronics, No. 305 (the Dec. 6, 1982 issue). The systems described therein are suitable for the ink-jet recording method used in the present invention.

Some of them will be described. First, there is an electrostatic attraction system. In this system, there are a method in which a strong electric field is applied between a nozzle and an accelerating electrode placed several millimeters ahead to successively draw an ink in the form of droplets out of the nozzle, and information signals are applied to deflecting electrodes while the drown ink droplets are flying between the deflecting electrodes, thereby conducting recording, and a method in which ink droplets are ejected according to information signals without deflecting the ink droplets. Both methods are effective for application to the ink-jet printing method used in the present invention.

As the second system, there is a system in which a high pressure is applied to an ink by a small-sized pump, and a nozzle is mechanically vibrated by a quartz oscillator or the like, thereby forcedly ejecting ink droplets. The ejected ink droplets are electrically charged according to information signals at the same time as the ejection. The charged ink droplets are deflected according to the degree of charge while they pass through between deflecting electrodes. As another system making good use of this system, there is also a system called a microdot ink-jet system. In this system, an ink pressure and exciting conditions are kept at optimum values within certain ranges, thereby ejecting two ink droplets of large and small sizes from an orifice. Of these ink droplets, only the ink droplets of the small size are used in recording. This system features that a group of minute ink droplets can be ejected even from an ordinary wide orifice.

As the third system, there is a piezoelectric system. This system uses, as a means for pressurizing an ink, a piezoelectric element instead of mechanical means such as a pump as used in other systems. Electric signals are applied to the piezoelectric element to cause mechanical displacement, thereby applying a pressure to an ink to eject the ink from an orifice. As the ink-jet recording method used in the present invention, an ink-jet system described in Japanese Patent Application Laid-Open No. 54-59936, in which an ink undergoes a rapid volumetric change by an action of thermal energy applied to the ink, so that the ink is ejected out of an orifice by the working force generated by this change of state, may be used effectively.

In the present invention, the disperse dye-containing liquid ink ejected by the ink-jet recording method is then received on an ink-absorbent printing sheet to temporarily form an image. Therefore, the recording sheet is set in contact on a receiving layer on a base material and heated to transfer the image, by which the image is formed directly on the base material provided with the receiving layer by an ink-jet printing system, and then the image is diffused into the receiving layer by heating. This can avoid the following disadvantages incurred by direct formation of an image on a base material.

First, because the base material used is ink-nonabsorbent, an ink-absorbent capacity is small and then ink droplets formed on the base material aggregate each other, so that any beautiful image cannot be formed. This problem is serious when an image is formed using two or more inks of different colors because defective coloring and bleeding at boundaries between different colors occur. Second, a disperse dye remaining on the surface of the receiving layer after diffused by heating must be washed and removed.

As the printing sheet used herein, those generally used in ink-jet recording methods may be used. As examples of the most common sheet, may be mentioned those comprising, as a main component, cellulose, which are called plain paper. Those provided with a coating layer for controlling ink absorbency, such as glossy paper and OHP, may also be used. However, the greatest care must be taken in using them because the coating layer may come to adhere to the base material due to heating upon transfer, or the transfer of the disperse dye to the base material may be deteriorated.

The receiving layer, which is a feature of the present invention, will now be described.

In the present invention, a resin having a pencil hardness of H or harder as determined by the pencil hardness test in accordance with JIS K 5400 is used in the receiving layer. Such a resin can prevent the following problems. A press mark of the transfer sheet is left on the receiving layer when the transfer is conducted by the close contact under heat, and the receiving layer adheres to the transfer sheet to fail to separate them from each other. In addition, the scratch resistance, stain resistance and fastness properties of image of the resultant image formed article are fully satisfactory under conditions of ordinary use.

The receiving layer according to the present invention may also include a resin the pencil hardness of which turns H or harder owing to progress in a certain reaction by the heating in the transfer step. The heating in the transfer step includes preheating of the base material right before the close contact of the transfer sheet with the receiving layer, to say nothing of heating in a state that the transfer sheet has been brought into close contact with the receiving layer.

Specific examples of materials for forming such a receiving layer include alkyd resins obtained from a polybasic acid (azelaic acid, chlorendic acid, succinic acid, trimellitic acid, o-phthalic acid, isophthalic acid, terephthalic acid, maleic acid, fumaric acid, adipic acid, sebacic acid or the like), a polyhydric alcohol (α-methylglucoside, dipentaerythritol, glycerol, glycolic acid, trimethylolmethane, trimethylolpropane, tripentaerythritol, sorbitol or the like) and a fatty acid; silicon alkyd resins obtained by reacting an alkyd resin with a silicon intermediate such as siloxane; amino resins obtained by reacting formaldehyde with urea or melamine, such as urea-formaldehyde resins and melamine-formaldehyde resins; epoxy resins crosslinked by an amino resin, phenolic resin, amine, polyamide, isocyanate or the like; polyester resins; unsaturated polyester resins; silicone resins; urethane resins; polyamide resins; polyimide resins; fluororesins; etc. Acrylic resins obtained by polymerization or copolymerization of an acrylic or methacrylic esters may also be used. Mixtures and reaction products of these resins may also be included.

Among these resins, the urethane resins, which are reaction products of an isocyanate compound with a compound having active hydrogen in its molecule, for example, a polyhydroxy compound or an amino group-containing compound, are mentioned as the most preferable resins because they can provide a receiving layer having a high hardness, and make the color density of an image transferred high. Specific examples of the isocyanate compound include aromatic isocyanates such as 2,4-toluylene diisocyanate, 2,6-toluylene diisocyanate, m-phenylene diisocyanate, p-phenylene diisocyanate, 2-chloro-1,4-phenylene diisocyanate, 1-chloro-2,4-phenylene diisocyanate, 1,5-naphthylene diisocyanate, 4,4'-diphenylmethane diisocyanate, and compounds of the formulae

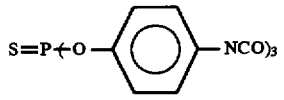

and

-continued

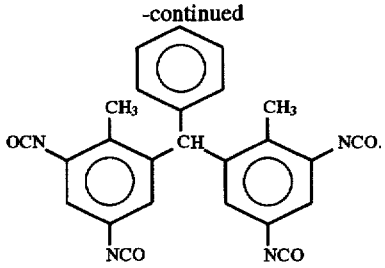

Aliphatic and alicyclic polyisocyanates may also be used. Specific examples thereof include hexamethylene diisocyanate, hexamethylene triisocyanate, isophorone diisocyanate, etc. Modified products and derivatives of these isocyanates may also be preferably used.

Examples of the polyhydroxy compound include polyether polyols, polyester polyols, acrylic polyols, phenolic resin polyols, epoxy polyols, polyester polyether polyols, carbonate polyols, etc.

As an amino group containing compound, primary and secondary di- and poly-amines can preferably be used. Specific examples of these compounds include 3,3'-diaminodiphenylmethane as ones having a diphenylmethanediamine structure.

The reaction products of these compounds are generally colorless and transparent, easily provided as products having a hardness of H or harder and can make the color density of an image transferred high. Therefore, they are suitable for use in the receiving layer according to the present invention.

In the case of a reaction using the isocyanate, it must be avoided to mix water except for the case where water is used with particular intent because carbon dioxide is generated by the reaction. The same may be said of carboxyl group-containing compounds.

It is also effective to add a silane coupling agent to the receiving layer as needed. As the effect of the silane coupling agent added, it is expectable to improve the adhesion between the base material and the resin as generally said. In the system using the isocyanate compound, water content can be reduced owing to hydrolysis, and so such a coupling agent is preferred. The hydroxyl group formed by the hydrolysis reacts with the isocyanate, whereby a receiving layer having higher mechanical strength can be formed. The amount of the silane coupling agent to be used is of the order of from 0.1 to 30% by weight based on the whole resin. If the amount is less than 0.1% by weight, the effect of the addition cannot be exhibited. On the other hand, any amount exceeding 30% by weight results in a receiving layer which tends to become brittle and also deteriorated in adhesion to the base material.

Specific examples of the silane coupling agent include β-(3,4-epoxycyclohexyl)ethyltrimethoxysilane, γ-glycidoxypropyltrimethoxysilane, γ-mercaptopropyltrimethoxysilane, γ-mercaptopropylmethyldimethoxysilane, methyltrimethoxysilane, dimethyldimethoxysilane, methyltriethoxysilane, phenyltrimethoxysilane, vinyltrimethoxysilane, vinyltriethoxysilane, γ-methacryloxypropyl-trimethoxysilane, γ-aminopropyltriethoxysilane, etc.

Saturated polyester resins generally used in sublimate thermal transfer recording and the like and having a pencil hardness lower than H show good transfer property for disperse dyes low in transfer temperature, which are used in sublimate thermal transfer recording and the like. However, such resin cannot be used in the present invention in which disperse dyes high in transfer temperature are used, because they bring on a disadvantage that the transfer sheet cannot be successfully separated.

As a method of coating the base material with the resin as described above, the resin may be melted at a high temperature and directly applied though it is thermoplastic. However, it is generally only necessary to apply precursor unreacted compounds of a resin to be coated, or its dilute solution, emulsion or colloid suspension in a solvent by a process such as spray coating, dip coating, wire bar coating, applicator coating, spin coating, roll coating, electrodeposition coating or brush coating. The coated base material is dried to remove the solvent, and a cure reaction is optionally performed, whereby a receiving layer can be formed.

When an isocyanate is used, the removal of the solvent by drying and cure reaction under heat may preferably be performed at two steps. Water, which is contained as an impurity, is removed together with the solvent by first heating at a relatively low temperature, after which the reaction is completed by second heating at a high temperature. In particular, when the coating is performed by the spray coating, there is a possibility that the temperature of the resin coating may be lowered by rapid vaporization of the solvent, and water in air may be entrained, thereby adversely affecting the reaction. Therefore, this two-step heating is particularly effective. The first heating is conducted under conditions of 100° C. or lower for from 5 minutes to 2 hours, while the second heating is performed under conditions of from 100° to 250° C. for from 5 minutes to 3 hours.

A step of transferring the disperse dye from the transfer sheet to the receiving layer will now be described.

The first importance in this step is to keep the transfer sheet in close contact with the surface of the base material, or the receiving layer. They are generally brought into contact with each other under a pressure of from about 0.1 to 5 kg/cm$^2$ using a pressure source such as spring or high-pressure air.

Second, with respect to heating, it is effective to preheat the base material with a view toward shortening treating time and obtaining even temperature distribution. Finally, the transfer sheet and the receiving layer are kept in close contact with each other at a temperature from 150° to 250° C. for from several seconds to several minutes. These conditions may be suitably determined from the ranges of the above-described conditions taking consideration of the heat resistance of the base material, the sublimating tendency of the disperse dye and the heat resistance of the receiving layer. If the transfer temperature is low, or the transfer time is short, the disperse dye is not fully transferred from the transfer sheet to the receiving layer, resulting in only an image low in color density. If the transfer temperature is raised than the step needs, or the transfer time is prolonged than the step needs on the other hand, the disperse dye is decomposed or vaporized out of the receiving layer, resulting in only a faded image.

After the above transfer step, the heating and pressurization are completed, and the transfer sheet is separated from the base material. According to the receiving layer of the present invention, the transfer sheet is easily separated. No press mark is left on the surface of the receiving layer.

In the present invention, a transparent resin can be further overcoated on the receiving layer, thereby obtaining a printed article having far excellent mechanical strength, light fastness, stain resistance, chemical resistance and mildew-proofing property.

A material forming the overcoat layer is required not to impair the image of the printed article, namely, be colorless and transparent as a color tone. More specifically, it is necessary to limit rise in reflection density after the application of the overcoat layer to 0.5 or lower in a coating thickness described below. Although necessary transparency varies according to the pattern of the printed article, it is unavoidable to give a feeling of deteriorated image quality due to a colored or opaque feeling except for a special intention if the rise in reflection density exceeds 0.5. With respect to mechanical strength, such a material preferably has a pencil hardness of 2H or harder, more preferably 4H or harder as determined by the pencil hardness test in accordance with JIS K 5400. If the hardness of this degree can be achieved, such a material can be used in the above application with little problem.

As such a material for the overcoat layer, those meeting the above properties may be chosen for use from the materials for the receiving layer as described above.

As a method of coating the receiving layer with such a resin, it is generally only necessary to apply precursor unreacted compounds of a resin to be coated, or its dilute solution, emulsion or colloid suspension in a solvent by a process such as spray coating, curtain coating, dip coating, wire bar coating, applicator coating, spin coating, roll coating, electrodeposition coating or brush coating. The coated receiving layer is dried to remove the solvent, and a cure reaction is optionally performed, whereby an overcoat layer can be provided.

The coating thickness of the overcoat layer is preferably within a range of from 0.1 to 50 μm, more preferably from 1 to 30 μm in terms of the thickness after cure. If the coating thickness is thinner than 0.1 μm, it is difficult to completely cover a necessary part of the receiving layer due to irregularities of the receiving layer and influence of foreign matter contained upon the coating, so that percent occurrence in defective coating becomes high. In addition, necessary mechanical strength cannot be achieved. When an ultraviolet absorbent and a mildew-proofing agent, which will be described subsequently, are contained in the overcoat layer, their contents must be increased for the purpose of developing the effects of such agents. Therefore, it is further difficult to obtain the properties required of the overcoat layer. If the coating thickness of the overcoat layer exceeds 50 μm on the other hand, a further merit as to the properties can be scarcely obtained, leading to an economical loss. Peeling or cracking may occur in some cases due to shrinkage of the overcoat layer upon its cure. Therefore, such a too thin or thick coating thickness is not preferable.

When the overcoat layer is applied, cissing of the overcoat layer may occur according to its compatibility with the receiving layer as the undercoating. In order to prevent the cissing, it is effective in the present invention to treat the surface of the receiving layer prior to the overcoating so as not to cause the cissing. As specific examples of this treatment, a treatment with oxygen plasma and a treatment with ozone generated by ultraviolet-light irradiation in an oxygen-containing gas are particularly preferred.

According to a preferred embodiment of the present invention, an ultraviolet absorbent or/and an ultraviolet screening agent are contained in the overcoat layer. This embodiment can improve the light fastness of dyes which form an image, and prevent deterioration by yellowing of the receiving layer and overcoat layer themselves, thereby achieving good long-term stability of the image.

The ultraviolet absorbent used in the present invention means an agent which absorbs rays having a wavelength (300 to 450 nm) of high energy level in an ultraviolet region and discharges the rays as thermal energy, and acts to prevent the discoloration and fading of the resulting printed image by ultraviolet rays in sunlight and/or illumination light.

When such an ultraviolet absorbent is added into the overcoat layer in the present invention, it is preferable to use it in an amount ranging from 0.1 to 10% by weight based on the weight of the material forming the overcoat layer. If the amount of the ultraviolet absorbent to be used is less than 0.1% by weight, the effect of improving the light fastness of the resulting image becomes insufficient. If it is used in an amount exceeding 10% by weight on the other hand, no effects according to the excessive amount can be brought about, and moreover the film-forming property and film properties of the overcoat layer are adversely affected. It is hence not preferable to add such an agent in any amount outside the above range.

As the ultraviolet absorbent used in the present invention, there may be used any conventionally-known agents, for example, salicylate, benzophenone, benzotriazole, acrylonitrile, hindered amine and metal complex type ultraviolet absorbents. Preferable examples thereof include phenyl salicylate, p-tert-butylphenyl salicylate, p-octyl salicylate, 2-hydroxybenzophenone, 2,4-dihydroxybenzophenone, 2-hydroxy-4-methoxybenzophenone, 2-hydroxy-4-methoxy-2'-carboxybenzophenone, 2-hydroxy-4-methoxy-5-sulfobenzophenone trihydrate, 2-hydroxy-4-octoxybenzophenone, 2-hydroxy-4-octadecyloxybenzophenone, 2-hydroxy-4-methoxybenzophenone-5-sulfonic acid, 2-hydroxy-4-dodecyloxybenzophenone, 2,2'-dihydroxy-4-methoxybenzophenone, 2,2'-dihydroxy-4,4'-dimethoxybenzophenone, 2,2',4,4'-tetrahydroxybenzophenone, sodium 2,2'-dihydroxy-4,4'-dimethoxy-5-sulfobenzophenone, 5-chloro-2-hydroxybenzophenone, 2-(2'-hydroxy-4'-octoxyphenyl)benzotriazole, 2-(2'-hydroxy-3'-t-butyl-5'-methylphenyl)-5-chlorobenzotriazole, 2-(2'-hydroxy-3'-t-butyl-5'-octylphenyl propionato)-5-chlorobenzotriazole, (5'-octylphenyl propionato)-5-chlorobenzotriazole, 2-(2'-hydroxy-5'-methyl)benzotriazole, 2-(2'-hydroxy-5'-tert-butylphenyl)benzotriazole, 2-(2'-hydroxy-3', 5-di-tert-butylphenyl)benzotriazole, 2-(2'-hydroxy-3', 5'-tert-butylphenyl)-5-chlorobenzotriazole, 2-(2'-hydroxy-3',5'-tert-amylphenyl)benzotriazole, 2-[2-hydroxy-3,5-di(2,2-dimethylbenzene)-phenyl]-2H-benzotriazole, 2-ethylhexyl-2-cyano-3,3'-diphenyl acrylate, ethyl-2-cyano-3,3'-diphenyl acrylate, nickel bis(octylphenyl) sulfide, nickel [2,2'-thiobis(4-tert-octylphenolate)]-n-butylamine, polyethylene glycol 3-[3-(2H-benzotriazol)-2-yl-5-tert-butyl-4-hydroxyphenyl] propionate monoester and diester, nickel complex-3,5-di-tert-butyl-4-hydroxybenzyl-phosphoric acid monoethylate, nickel dibutyldithiocarbamate, resorcinol monobenzoate, hexamethylphosphoryltriamide, 2,4,5-trihydroxybutylphenone, di-p-octylphenyl terephthalate, di-p-n-nonylphenyl isophthalate, hindered amines such as bis(1,2,2,6-tetramethyl-4-piperidine) 2-(3,5-di-tert-butyl-4-hydroxybenzyl)-2-n-butylmalonate, and comonomers introduced in copolymers together with other monomers, such as 2-oxy-4-(2-oxy-3-methacryloxy)propoxybenzophenone and ethyl diphenylmethylenecyanoacetate.

The ultraviolet screening agent used in the present invention means an agent which blocks rays having a wavelength in an ultraviolet region, and acts to prevent the discoloration and fading of the resulting printed image by ultraviolet rays.

When such an ultraviolet screening agent is added into the overcoat layer in the present invention, it is preferable to use it in an amount ranging from 0.1 to 30% by weight based on the weight of the material forming the overcoat layer. If the amount of the ultraviolet screening agent to be used is less than 0.1% by weight, the effect of improving the light fastness of the resulting image becomes insufficient. If it is used in an amount exceeding 30% by weight on the other hand, no effects according to the excessive amount can be brought about, and moreover opacity increases, so that appreciation of the resulting image is impeded. In addition, the film-forming property and film properties of the overcoat layer may be adversely affected in some cases. It is hence not preferable to add such an agent in any amount outside the above range. Examples of the ultraviolet screening agent used in the present invention include silica, talc, mica and cerium oxide.

As the mildew-proofing agent preferably used in the present invention, there may be used any conventionally-known agents. When such a mildew-proofing agent is added into the overcoat layer in the present invention, it is preferable for the agent to account for 0.01 to 10% by weight of the weight of the overcoat layer. If the amount of the mildew-proofing agent to be used is less than 0.01% by weight, its effect becomes insufficient. If it is used in an amount exceeding 10% by weight on the other hand, the mildew-proofing property can not be improved correspondingly to the used amount. It is hence not preferable to add such an agent in any amount outside the above range.

Since the effects of mildew-proofing agents vary according to the kinds of fungi, it is also effective to use two or more mildew-proofing agents in an amount within the above range. Preferable examples of such mildew-proofing agents include benzoic acid, sorbic acid, p-hydroxybenzoic esters, dihydroxyacetic acid, propionic acid and salts thereof, as well as diphenyl, o-phenylphenol, copper 8-quinolinolate, PCP, PCP-Na, p-chloro-m-xylenol, dihydroxyethylamine pentachlorophenol, 4-chloro-2-phenylphenol, N-(trichloromethylthio)phthalamide, N,N-dimethyl-N'-phenyl(N'-fluorodichloromethylthio) sulfamide, N-(trichloromethylthio)-4-cyclohexene-1,2-dicarboxyimide, 2,4,5,6-tetrachloro-isophthalonitrile, bis(tri-n-butyltin) oxide, tributyltin laurate, 10,10'-oxybisphenoxyarsine and thiapentazole.

Cure processes of the overcoat layer include heat curing and radiation exposure. In each case, the cure must be performed at a temperature lower than the heating temperature upon the transfer because the image formed by the sublimate dye is adversely affected if the temperature upon the cure reaction is too high.

The present invention will hereinafter be described more specifically by the following Examples. Incidentally, all designations of "part" or "parts" as will be used in the following examples mean part or parts by weight unless expressly noted.

EXAMPLE 1

The following ink compositions were used.

Ink composition (A):

| | |
|---|---|
| Disperse dye (C.I. Disperse Yellow 76) | 5 parts |
| Anionic surfactant (Ionet D-2, trade name; product of Sanyo Chemical Industries, Ltd.) | 4 parts |
| Diethylene glycol | 15 parts |
| Triethylene glycol monomethyl ether | 10 parts |
| Water | 70 parts. |

After all the above components were dispersed for about 36 hours in a ball mill made of alumina, the pH of the dispersion was adjusted to 7.6 with lithium hydroxide, followed by further dispersing for 2 hours in a homogenizer. Thereafter, coarse particles were removed by centrifugation, thereby obtaining a water-based ink composition (A).

Ink composition (B):

| | |
|---|---|
| Disperse dye (C.I. Disperse Yellow 79) | 3 parts |
| Disperse dye (C.I. Disperse Blue 60) | 3 parts |
| Anionic surfactant (Ionet D-2, trade name; product of Sanyo Chemical Industries, Ltd.) | 5.5 parts |
| Ethylene glycol | 25 parts |
| Glycerol | 5 parts |
| 1,3-Dimethylimidazolinone | 5 parts |
| Water | 60 parts. |

A water-based ink composition (B) was obtained from the above components in the same manner as in the ink composition (A).

Ink composition (C):

| | |
|---|---|
| Disperse dye (C.I. Disperse Yellow 56) | 3 parts |
| Anionic surfactant (Nikkol OPT-100s, trade name; product of Nikko Chemicals Co., Ltd.) | 1.5 parts |
| Nonionic surfactant (Emulgen 911, trade name; product of Kao Corporation) | 0.2 part |
| Isopropyl alcohol | 0.5 part |
| Polyethylene glycol | 5 parts |
| Water | 75 parts. |

After all the above components were dispersed for about 40 hours in a ball mill made of alumina, the pH of the dispersion was adjusted to 7.4 with lithium hydroxide, followed by further dispersing for 2 hours. Thereafter, coarse particles having a particle size of 5 μm or greater were removed by a Fluoropore Filter FP-500 (trade name; product of Sumitomo Electric Industries, Ltd.), thereby obtaining a water-based ink composition (C).

Ink composition (D):

A water-based ink composition (D) was obtained in exactly the same manner as in the ink composition (A) except that a disperse dye, C.I. Disperse Red 227 was used in place of the disperse dye, C.I. Disperse Yellow 76 in the ink composition (A).

The inks thus obtained were charged in ink tanks of a BJC-600J (trade name; ink-jet printer of bubble jet system; manufactured by Canon Inc.) to form an image on PB paper (trade name; plain paper; product of Canon Inc.), thereby obtaining a transfer sheet.

A material having the following composition was used as a material for a receiving layer.

| | |
|---|---|
| Sericol SP-3100 (trade name; urethane resin; product of Teikoku Ink Mfg. Co., Ltd.) | 100 parts |
| Sericol 2100 (trade name; urethane resin; product of Teikoku Ink Mfg. Co., Ltd.) | 13 parts |
| n-Butyl acetate (diluent solvent; product of Kishida Chemical Co., Ltd.). | 40 parts |

This composition was sprayed on the surface of a white tile 110 mm square by a sprayer so as to give a dry coating thickness of about 10 μm. After the coating, the white tile was heated for 30 minutes at 90° C. and then for 30 minutes at 150° C., thereby removing the solvent and conducting a cure reaction. The thus-formed receiving layer had a pencil hardness of H as measured in accordance with JIS K 5400.

The image-formed surface of the transfer sheet as described above was brought into close contact with the receiving layer formed on the tile to treat them for 6 minutes at 200° C. under a pressure of 0.3 kg/cm$^2$, thereby transferring the disperse dyes to the receiving layer. After the transfer treatment, the transfer sheet was separated from the receiving layer. The transfer sheet was easily separated, and any press mark was not left on the surface of the receiving layer. The resultant image was bright and sufficient in color density, and was such that the original image was faithfully reproduced.

This tile was immersed for 1 hour in each of commercially-available household mildew-removing cleaner and mildew-proofing agents, which will be described subsequently, washed with water and then dried, thereby observing whether abnormalities such as blister, cracking, peeling and blushing of the receiving layer, and changes of the image such as fading occurred or not. As a result, the tile sample underwent no changes on both receiving layer and image and was the same as before the immersion. It was hence confirmed that the receiving layer had good chemical resistance.

Household mildew-removing cleaner:

KABI-KILLER (trade name; product of Johnson Company, Ltd.; alkaline)

Components: sodium hypochlorite, sodium hydroxide (1%) and surfactant.

KABI-KOROJI (trade name; product of Sunday Paint Co., Ltd.; weakly acid)

Components: L-lactic acid, hydrogen peroxide surfactant and mildew-proofing agent.

KABI-KOROJI (trade name; product of Sunday Paint Co., Ltd.)

Components: vegetable essential oil and surfactant.

When each ink composition was dropped into KABI-KILLER, it faded within several minutes. Therefore, it is considered that in the image formed according to the present invention, the disperse dyes penetrate into the receiving layer so as not to come into contact with the chemicals.

The surface of the receiving layer of the image-formed tile formed in this example was then rubbed 30 times with each of the following wipers under a load of about 1 kg.

KIMWIPE (trade name; paper wiper; product of Jujo Kimberly Co., Ltd.)

BEMCOT (trade name; cotton wiper; product of Asahi Chemical Industry Co., Ltd.).

This test was conducted on the assumption that stains adhered on tiles are removed. In fact, butter, rice and the like were attached to the tile to wipe off them under the above conditions. As a result, the stains could be almost wiped off without leaving traces of the stains. Besides, the surface of the image-formed tile was rubbed with nails under a load of about 1 kg. As a result, it received no scratches.

EXAMPLE 2

A receiving layer was formed in the same manner as in Example 1 except that the amount of the diluent solvent in the coating composition used in Example 1 was changed to 10 parts, glass was used as a base material, and the coating process was changed to spin coating, thereby forming a transferred image. The thus-obtained receiving layer had a pencil hardness of H. After the transfer step, the transfer sheet was easily separated, and any press mark was not left on the surface of the receiving layer. The resultant image was bright and sufficient in color density, and was such that the original image was faithfully reproduced. The chemical resistance and scratch resistance were tested in the same manner as in Example 1. As a result, no problems occurred.

EXAMPLE 3

An experiment was performed in the same manner as in Example 2 except that the base material was changed to an alumina ceramic, aluminum killed steel plate. As a result, the transfer sheet was easily separated, and any press mark was not left on the surface of the receiving layer. The resultant image was bright and sufficient in color density, and was such that the original image was faithfully reproduced. The chemical resistance and scratch resistance were tested in the same manner as in Example 1. As a result, no problems occurred.

EXAMPLE 4

A resin having the following composition was prepared as a receiving layer to apply onto a white tile by spray coating.

| | |
|---|---|
| Desmophen 651-67 (trade name; branched polyester; product of Sumitomo Bayer Urethane Co., Ltd.) | 162 parts |
| Sumidur N75 (trade name; aliphatic polyisocyanate; product of Sumitomo Bayer Urethane Co., Ltd.) | 100 parts |
| n-Butyl acetate (diluent solvent; product of Kishida Chemical Co., Ltd.). | 100 parts |

Subsequent steps were performed in the same manner as in Example 1. The thus-obtained receiving layer had a pencil hardness of H. As a result, as with Example 1, the transfer sheet was easily separated, and any press mark was not left on the surface of the receiving layer. The resultant image was bright and sufficient in color density, and was such that the original image was faithfully reproduced. The chemical resistance and scratch resistance were tested in the same manner as in Example 1. As a result, no problems occurred.

EXAMPLE 5

L-40 (trade name, comb polymer; backbone: methyl methacrylate; superstrate: N-methylolacrylamide; product of Soken Chemical & Engineering Co., Ltd.) was applied as a receiving layer onto an aluminum sheet by spin coating.

Drying was performed at 160° C. for 60 minutes. The thus-obtained receiving layer had a pencil hardness of 3H. Subsequent steps were performed in the same manner as in Example 1 except that the transfer conditions were changed to a pressure of 0.5 kg/cm$^2$, a temperature of 180° C. and treating time of 6 minutes. As a result, the transfer sheet was easily separated, and any press mark was not left on the surface of the receiving layer. The resultant image was bright, but somewhat low in color density compared with those of Examples 1 to 4. The chemical resistance and scratch resistance were tested in the same manner as in Example 1. As a result, no problems occurred.

EXAMPLE 6

The following composition was applied as a receiving layer onto glass by spin coating.

| | |
|---|---|
| NK Ester A-TMPT-3EO (trade name; acrylic monomer; product of Shin-Nakamura Chemical Co., Ltd.) | 30 parts |
| Arronix M-315 (trade name, acrylic monomer; product of Toagosei Chemical Industry Co., Ltd.) | 30 parts |
| Dianal BR-102 (trade name; acrylic polymer; product of Mitsubishi Rayon Co., Ltd.) | 40 parts |

-continued

| | |
|---|---|
| PERMEK N (trade name; heat curing agent: methyl ethyl ketone peroxide; product of Nippon Oil & Fats Co., Ltd.) | 2 parts |
| Toluene (diluent solvent) | 100 parts |
| Methyl ethyl ketone (diluent solvent) | 100 parts. |

Drying was performed at 80° C. for 30 minutes and then at 160° C. for 60 minutes. The thus-obtained receiving layer had a pencil hardness of 5H. Subsequent steps were performed in the same manner as in Example 1. As a result, the transfer sheet was easily separated, and any press mark was not left on the surface of the receiving layer. The resultant image was bright, but somewhat low in color density compared with those of Examples 1 to 4. The chemical resistance and scratch resistance were tested in the same manner as in Example 1. As a result, no problems occurred.

EXAMPLE 7

The following composition was applied as a receiving layer onto glass by spin coating.

| | |
|---|---|
| Desmophen 651-67 (trade name; branched polyester; product of Sumitomo Bayer Urethane Co., Ltd.) | 140 parts |
| Desmodur CT Staple (trade name; block isocyanate; product of Sumitomo Bayer Urethane Co., Ltd.) | 100 parts |
| n-Butyl acetate (diluent solvent; product of Kishida Chemical Co., Ltd.). | 100 parts |

Drying was performed at 60° C. for 60 minutes. The pencil hardness of the receiving layer was HB. Transfer was conducted by heating a transfer sheet for 10 minutes at 200° C. while bringing it into light contact with the receiving layer, and then applying a pressure of 0.3 kg/cm$^2$ to the transfer sheet to further heat it for 3 minutes while bringing it into close contact with the receiving layer. Subsequent steps were performed in the same manner as in Example 1. The pencil hardness of the receiving layer after the transfer turned H. As a result, as with Example 1, the transfer sheet was easily separated, and any press mark was not left on the surface of the receiving layer. The resultant image was bright and sufficient in color density, and was such that the original image was faithfully reproduced. The chemical resistance and scratch resistance were tested in the same manner as in Example 1. As a result, no problems occurred.

COMPARATIVE EXAMPLE 1

A material having the following composition was used as a material for a receiving layer.

| | |
|---|---|
| Beckolite M-6402 (trade name; oil-free alkyd resin; product of Dainippon Ink & Chemicals, Incorporated) | 90 parts |
| Superbeckamine J820 (trade name; butylated melamine resin; product of Dainippon Ink & Chemicals, Incorporated) | 10 parts |
| n-Butyl acetate (diluent solvent; product of Kishida Chemical Co., Ltd.). | 30 parts |

This composition was sprayed on the surface of a white tile 110 mm square by a sprayer so as to give a dry coating thickness of about 10 μm. After the coating, the white tile was heated for 30 minutes at 90° C. and then for 30 minutes at 150° C., thereby removing the solvent and conducting a cure reaction. The thus-formed receiving layer had a pencil hardness of 3B as measured in accordance with JIS K 5400.

The image-formed surface of the transfer sheet as described in Example 1 was brought into close contact with the receiving layer formed on the tile to treat them for 6 minutes at 200° C. under a pressure of 0.3 kg/cm$^2$, thereby transferring the disperse dyes to the receiving layer. After the transfer treatment, the transfer sheet was separated. As a result, irregularities were left on the surface of the receiving layer, and the surface was lusterless. In addition, the surface of the receiving layer received scratches by scratch tests using KIMWIPE and nails.

COMPARATIVE EXAMPLE 2

A material having the following composition was used as a material for a receiving layer.

| | |
|---|---|
| Vyron 20SS (trade name; polyester resin; product of Toyobo Co., Ltd.) | 100 parts |
| Superbeckamine J820 (trade name; butylated melamine resin; product of Dainippon Ink & Chemicals, Incorporated) | 10 parts |
| n-Butyl acetate (diluent solvent; product of Kishida Chemical Co., Ltd.). | 30 parts |

This composition was sprayed on the surface of a white tile 110 mm square by a sprayer so as to give a dry coating thickness of about 10 μm. After the coating, the white tile was heated for 30 minutes at 90° C. and then for 30 minutes at 150° C., thereby removing the solvent and conducting a cure reaction. The thus-formed receiving layer had a pencil hardness of 3B as measured in accordance with JIS K 5400.

The image-formed surface of the transfer sheet as described in Example 1 was brought into close contact with the receiving layer formed on the tile to treat them for 6 minutes at 200° C. under a pressure of 0.3 kg/cm$^2$, thereby transferring the disperse dyes to the receiving layer. After the transfer treatment, it was attempted to separate the transfer sheet. However, it was impossible to separate the transfer sheet because it firmly adhered to the receiving layer.

COMPARATIVE EXAMPLE 3

A material having the following composition was used as a material for a receiving layer.

| | |
|---|---|
| Vyron 20SS (trade name; polyester resin; product of Toyobo Co., Ltd.) | 100 parts |
| Sumidur N75 (trade name; aliphatic polyisocyanate; product of Sumitomo Bayer Urethane Co., Ltd.) | 20 parts |
| n-Butyl acetate (diluent solvent; product of Kishida Chemical Co., Ltd.). | 40 parts |

This composition was sprayed on the surface of a white tile 110 mm square by a sprayer so as to give a dry coating thickness of about 10 μm. After the coating, the white tile was heated for 30 minutes at 90° C. and then for 30 minutes at 150° C., thereby removing the solvent and conducting a cure reaction. The thus-formed receiving layer had a pencil hardness of 2B as measured in accordance with JIS K 5400.

The image-formed surface of the transfer sheet as described in Example 1 was brought into close contact with the receiving layer formed on the tile to treat them for 6 minutes at 200° C. under a pressure of 0.3 kg/cm$^2$, thereby transferring the disperse dyes to the receiving layer. After the transfer treatment, it was attempted to separate the transfer sheet. However, it was impossible to separate the transfer sheet because it firmly adhered to the receiving layer.

EXAMPLE 8

The surface of the printed article obtained in Example 1 was subjected for 30 seconds to an ultraviolet light/ozone cleaning. An Iozone cleaner (Model: OC-253) manufactured by IWASAKI ELECTRIC CO., LTD. was used as a cleaner. An overcoating material having the following composition was further applied by spray coating.

| | |
|---|---|
| ZPP-N-1000 (trade name; phosphazene type methacrylate; product of Kyoeisha Chemical Co., Ltd.) | 70 parts |
| NK Ester A-9530 (trade name; dipenta-erythritol polyacrylate; product of Shin-Nakamura Chemical Co., Ltd.) | 30 parts |
| Irgacure 184 (trade name; ultraviolet curing agent; product of CIBA-GEIGY (Japan) Limited) | 5 parts |
| Tinuvin 400 (trade name; ultraviolet absorbent; product of CIBA-GEIGY (Japan) Limited) | 3 parts |
| Tinuvin 123 (trade name; hindered amine; product of CIBA-GEIGY (Japan) Limited) | 2 parts |
| Cellosolve acetate (dilute solvent; product of Kishida Chemical Co., Ltd.) | 200 parts |
| Calcium propionate (mildew-proofing agent; product of Ueno Fine Chemicals Industry, Ltd.). | 0.3 part |

After the coating, the printed article was heated at 80° C. for 30 minutes to dry it, and then exposed to radiation having an intensity of 3 J/cm$^2$ from an extra-high pressure mercury lamp. The thus-formed overcoat layer had a film thickness of 15 μm. No cissing of the overcoat layer was observed, and the coating was successfully effected. The resulting image was bright and beautiful.

The thus-obtained printed article was evaluated as to whether it fully answered the object of the present invention or not. The evaluation methods and results will be described subsequently.

EXAMPLE 9

A printed article was produced in the same manner as in Example 8 except that white plate glass (Glass No. 7059, trade name, produced by Corning Glass Works) of 100 by 100 by 1.1 millimeters in dimensions was used as a base material. The surface of the printed article thus obtained was subjected to an oxygen plasma washing treatment under conditions described below. Namely, the treatment was conducted using an apparatus manufactured by Plasma Systems Co., Ltd. under conditions of RF power of 0.5 kW, a degree of vacuum of 1.2 Torr, an $O_2$ quantity of 300 SccM and treating time of 30 seconds. An overcoating material having the following composition was further applied by spray coating.

| | |
|---|---|
| BK-80 (trade name; acrylic polymer; product of Mitsubishi Rayon Co., Ltd.) | 50 parts |
| NK Ester A-9530 (trade name; dipenta-erythritol polyacrylate; product of Shin-Nakamura Chemical Co., Ltd.) | 25 parts |
| Arronix M-315 (trade name, highly hard acrylic monomer; product of Toagosei Chemical Industry Co., Ltd.) | 25 parts |
| Irgacure 651 (trade name; ultraviolet curing agent; product of CIBA-GEIGY (Japan) Limited) | 5 parts |

-continued

| | |
|---|---|
| Tinuvin 400 (trade name; ultraviolet absorbent; product of CIBA-GEIGY (Japan) Limited) | 3 parts |
| Tinuvin 123 (trade name; hindered amine; product of CIBA-GEIGY (Japan) Limited) | 2 parts |
| Cellosolve acetate (dilute solvent; product of Kishida Chemical Co., Ltd.) | 200 parts |
| Sodium dehydroacetate (mildew-proofing agent; product of The Nippon Synthetic Chemical Industry Co., Ltd.). | 0.4 part |

After the coating, the printed article was heated at 80° C. for 30 minutes to dry it, and then exposed to radiation having an intensity of 3 J/cm$^2$ from an extra-high pressure mercury lamp. The thus-formed overcoat layer had a film thickness of 18 μm.

EXAMPLE 10

An overcoating material having the following composition was applied by spray coating to the surface of the printed article obtained in Example 4.

| | |
|---|---|
| Glassca HPC7001 (trade name; silica resin; product of Japan Synthetic Rubber Co., Ltd.) | 90 parts |
| Glassca 402H (trade name; curing agent for Glassca; product of Japan Synthetic Rubber Co., Ltd.) | 10 parts |
| SERIGUARD S-3018 (trade name; ultraviolet screening agent; product of Nippon Inorganic Chemical Co., Ltd.) (10% by weight based on the true weight of Glassca) | 2.2 parts |
| Sodium dehydroacetate (mildew-proofing agent; product of The Nippon Synthetic Chemical Industry Co., Ltd.). | 0.4 part |

The printed article thus coated was heated at 150° C. for 10 minutes to cure the overcoating material. The thickness of the coating after the curing was measured and found to be 8 μm.

EXAMPLE 11

A printed article was produced in the same manner as in Example 8 and then coated with an overcoating material having the following composition by spray coating.

| | |
|---|---|
| Glassca HPC7002 (trade name; silica resin; product of Japan Synthetic Rubber Co., Ltd.) | 75 parts |
| Glassca 402H (trade name; curing agent for Glassca; product of Japan Synthetic Rubber Co., Ltd.) | 25 parts |
| Tinuvin 900 (trade name; ultraviolet absorbent; product of CIBA-GEIGY (Japan) Limited) (3% by weight based on the true weight of Glassca) | 0.66 part |
| Tinuvin 144 (trade name; hindered amine; product of CIBA-GEIGY (Japan) Limited) | 0.44 part |
| Methyl ethyl ketone (dilute solvent; product of Kishida Chemical Co., Ltd.) | 30 parts |
| Sodium dehydroacetate (mildew-proofing agent; product of The Nippon Synthetic Chemical Industry Co., Ltd.). | 0.4 part |

The printed article thus coated was heated at 150° C. for 10 minutes to cure the overcoating material. The thickness of the coating after the curing was measured and found to be 7 μm.

The printed articles obtained in Examples 8 to 11 were evaluated in accordance with the following evaluating methods. In Examples 8 to 11, the same ink compositions as those used in Example 1 were used. The results are shown in Table 1.

(1) Cissing of overcoat layer:

Evaluated by visual observation.

(2) Pencil hardness:

The pencil hardness of each sample was measured by means of a pencil scratch tester for film recommended by JIS in accordance with the method of JIS K 5400. The degree of scratches on the surface was observed for ranking.

(3) Optical density (O.D.) of image:

The optical densities of each image sample before and after the application of the overcoat layer were measured in the same region by means of a Macbeth densitometer TR524, thereby finding the remainder.

(4) Scratch resistance:

The surface of each sample was reciprocatorily rubbed 30 times with a brush for tile joint made of polypropylene (product of Azuma Kogyo K.K.) under a load of about 1 kg, and then visually observed as to whether scratches were received or not. The scratch resistance was ranked as "A" where no scratches were observed, or "B" where scratches were observed.

(5) Resistance to marker:

Upon elapsed time of 24 hours after marking the surface of each sample with an oil-based black marker (product of Pilot Pen Co., Ltd.), the surface was wiped 50 times with gauze soaked with ethanol, and then visually observed as to whether abnormality occurred on the surface or not. The resistance to marker was ranked as "B" where blister and/or scratch of the coating film, trace of the mark, and/or the like was observed, or "A" where the surface was exactly the same as before the test.

(6) Light fastness:

Each sample was left over for 50 hours in a xenon arc fade-o-meter (Atlas C, trade name; 35 W, inner filter: quartz; outer filter: borosilicate) at 50° C. and 65% RH. The density of a red solid print area of the sample was measured before and after the test to use, an index to the light fastness, a percentage value obtained by dividing an optical density after the test by an optical density before the test. Namely, a greater value indicates better light fastness.

(7) Stain resistance:

Each printed article sample was left over for 15 days under conditions of 30° C. and 70% RH. The stain resistance was ranked as "B" where appreciation of the image was impeded due to generation of mold or mildew, and/or the like, or "A" where no stains were observed.

Overall evaluation was conducted from the above results. The results thereof are shown in Table 1.

TABLE 1

| | Example | | | |
|---|---|---|---|---|
| | 8 | 9 | 10 | 11 |
| Surface treatment | Effected | Effected | Not Effected | Not Effected |
| Cissing | A | A | A | A |
| Pencil hardness | 8H | 4H | 4H | 7H |
| Scratch resistance | A | A | A | A |
| Rise in O.D. | 0.01 | 0.01 | 0.1 | 0.01 |
| Resistance to marker | A | A | A | A |
| Light fastness | 90 | 90 | 88 | 89 |
| Overall evaluation | A | A | A | A |

According to the present invention, bright and high-color density images faithfully conforming to an original image can be formed on base materials such as pottery, glass, ceramics and metals, which have no liquid ink absorbency. The resultant image formed articles have chemical resistance and scratch resistance sufficient to be fit for use. Besides, no irregularities are left on the surface of the receiving layer upon the transfer step, and there are also no such troubles that the transfer sheet firmly adheres to the receiving layer to fail to separate. The resultant image formed articles further have excellent resistance to marker. Furthermore, there can be provided image formed articles which can prevent growth of mildew or mold and be hence satisfactorily fit for use in the open air and humid places.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. An image forming process, comprising the steps of:

ejecting droplets of a liquid ink containing a disperse dye according to predetermined information to form an image on an ink-absorbent printing sheet;

bringing the printing sheet into close contact under heat with an ink-nonabsorbent base material having a receiving layer for receiving the disperse dye to diffuse the disperse dye into the receiving layer; and separating the printing sheet from the base material, wherein the receiving layer comprises a resin having a pencil hardness of H or harder as determined by the pencil hardness test in accordance with JIS K 5400.

2. The image forming process according to claim 1, wherein the resin is a reaction product of a polyisocyanate compound with a compound having active hydrogen in a molecule.

3. The image forming process according to claim 2, wherein the resin is a reaction product of a polyisocyanate compound with a polyhydroxy compound or an amino group-containing compound.

4. The image forming process according to any one of claims 1 to 3, wherein the receiving layer is formed on the base material under heating conditions of 100° C. or lower for from 5 minutes to 2 hours and then of from 100° to 250° C. for from 5 minutes to 3 hours.

5. The image forming process according to claim 1, wherein the receiving layer contains a silane coupling agent in an amount ranging from 0.1 to 30% by weight based on the whole resin.

6. The image forming process according to claim 1, wherein the means for ejecting droplets of the liquid ink containing a disperse dye according to predetermined information is an ink-jet printing method.

7. The image forming process according to claim 6, wherein the ink-jet printing method is of a type that thermal energy is applied to ink to form ink droplets.

8. The image forming process according to claim 1, wherein the printing sheet is paper.

9. The image forming process according to claim 1, wherein the liquid ink is a water-based ink.

10. An image forming process, comprising the steps of:

ejecting droplets of a liquid ink containing a disperse dye according to predetermined information to form an image on an ink-absorbent printing sheet;

bringing the printing sheet into close contact under heat with an ink-nonabsorbent base material having a receiving layer for receiving the disperse dye to diffuse the disperse dye into the receiving layer; and separating the printing sheet from the base material, wherein the receiving layer comprises a resin the pencil hardness of which turns H or harder as determined by the pencil hardness test in accordance with JIS K 5400 by the step of the close contact under heat.

11. The image forming process according to claim 10, wherein the resin is a reaction product of a polyisocyanate compound with a compound having active hydrogen in a molecule.

12. The image forming process according to claim 11, wherein the resin is a reaction product of a polyisocyanate compound with a polyhydroxy compound or an amino group-containing compound.

13. The image forming process according to any one of claims 10 to 12, wherein the receiving layer is formed on the base material under heating conditions of 100° C. or lower for from 5 minutes to 2 hours and then of from 100° to 250° C. for from 5 minutes to 3 hours.

14. The image forming process according to claim 10, wherein the receiving layer contains a silane coupling agent in an amount ranging from 0.1 to 30% by weight based on the whole resin.

15. The image forming process according to claim 10, wherein the means for ejecting droplets of the liquid ink containing a disperse dye according to predetermined information is an ink-jet printing method.

16. The image forming process according to claim 15, wherein the ink-jet printing method is of a type that thermal energy is applied to ink to form ink droplets.

17. The image forming process according to claim 10, wherein the printing sheet is paper.

18. The image forming process according to claim 10, wherein the liquid ink is a water-based ink.

19. An image forming material, comprising a base material selected from the group consisting of pottery, glass, ceramics and metals; and a receiving layer provided on the base material comprising a resin having a pencil hardness of H or harder as determined by the pencil hardness test in accordance with JIS K 5400.

20. A printed article, comprising a base material selected from the group consisting of pottery, glass, ceramics and metals, on which a receiving layer comprising a resin having a pencil hardness of H or harder as determined by the pencil hardness test in accordance with JIS K 5400 is provided; and an image formed with a disperse dye on the receiving layer.

21. A process for forming an image with an ink on a printing medium, comprising the steps of:

ejecting droplets of an ink containing a disperse dye according to predetermined information to form an image on an ink-absorbent printing medium;

bringing the printing medium into close contact under heat with an ink-nonabsorbent base material having a receiving layer for receiving the disperse dye, the pencil hardness of the receiving layer being H or harder, to transfer and diffuse the disperse dye to and into the receiving layer;

separating the printing medium from the base material;

overcoating at least a part of the receiving layer of the image formed article obtained by the preceding steps with a substantially transparent resin; and then curing the transparent resin.

22. The image forming process according to claim 21, wherein the means for ejecting droplets of the ink containing a disperse dye according to predetermined information is an ink-jet printing method.

23. The image forming process according to claim 22, wherein the ink-jet printing method is of a type that thermal energy is applied to ink to form ink droplets.

24. The image forming process according to claim 21, wherein the printing medium is paper.

25. The image forming process according to claim 21, wherein the ink is a water-based ink.

26. The image forming process according to claim 21, wherein the overcoating resin cured has a pencil hardness of 2H or harder as determined by the pencil hardness test in accordance with JIS K 5400.

27. The image forming process according to claim 21, wherein the overcoating resin has such transparency that rise in optical density after the application of the resin is 0.5 or lower.

28. The image forming process according to claim 21, wherein the layer of the overcoating resin has a thickness ranging from 0.1 to 50 μm.

29. The image forming process according to claim 21, wherein the method of curing the overcoat layer is a method by heating.

30. The image forming process according to claim 29, wherein the heat curing temperature is lower than a temperature at which the printing medium is heated to transfer and diffuse the disperse dye to and into the receiving layer.

31. The image forming process according to claim 21, wherein the method of curing the overcoat layer is a method by radiation exposure.

32. The image forming process according to claim 21, wherein the overcoat layer contains at least one adhesive selected from the group consisting of ultraviolet absorbents, ultraviolet screening agents and mildew-proofing agents.

33. A process for forming an image with an ink on a printing medium, comprising the steps of:

ejecting droplets of an ink containing a disperse dye according to predetermined information to form an image on an ink-absorbent printing medium;

bringing the printing medium into close contact under heat with an ink-nonabsorbent base material having a receiving layer for receiving the disperse dye, the pencil hardness of the receiving layer being H or harder, to transfer and diffuse the disperse dye to and into the receiving layer;

separating the printing medium from the base material;

subjecting the receiving layer of the image formed article obtained by the preceding steps to a surface treatment;

overcoating at least a part of the receiving layer thus surface-treated with a substantially transparent resin; and then curing the transparent resin.

34. The image forming process according to claim 33, wherein the means for ejecting droplets of the ink containing a disperse dye according to predetermined information is an ink-jet printing method.

35. The image forming process according to claim 34, wherein the ink-jet printing method is of a type that thermal energy is applied to ink to form ink droplets.

36. The image forming process according to claim 33, wherein the printing medium is paper.

37. The image forming process according to claim 33, wherein the ink is a water-based ink.

38. The image forming process according to claim 33, wherein the surface treatment of the receiving layer of the image formed article is a treatment by oxygen plasma.

39. The image forming process according to claim 33, wherein the surface treatment of the receiving layer of the image formed article is a treatment with ozone generated by ultraviolet-light irradiation in an oxygen-containing gas.

40. The image forming process according to claim 33, wherein the overcoating resin cured has a pencil hardness of 2H or harder as determined by the pencil hardness test in accordance with JIS K 5400.

41. The image forming process according to claim 33, wherein the overcoating resin has such transparency that rise in optical density after the application of the resin is 0.5 or lower.

42. The image forming process according to claim 33, wherein the layer of the overcoating resin has a thickness ranging from 0.1 to 50 μm.

43. The image forming process according to claim 33, wherein the method of curing the overcoat layer is a method by heating.

44. The image forming process according to claim 43, wherein the heat curing temperature is lower than a temperature at which the printing medium is heated to transfer and diffuse the disperse dye to and into the receiving layer.

45. The image forming process according to claim 33, wherein the method of curing the overcoat layer is a method by radiation exposure.

46. The image forming process according to claim 33, wherein the overcoat layer contains at least one adhesive selected from the group consisting of ultraviolet absorbents and ultraviolet screening agents.

* * * * *